US011543196B2

(12) United States Patent
Underwood et al.

(10) Patent No.: US 11,543,196 B2
(45) Date of Patent: Jan. 3, 2023

(54) MONOLITHIC UPPER RECEIVER ASSEMBLY

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

(21) Appl. No.: 17/207,529

(22) Filed: Mar. 19, 2021

(65) Prior Publication Data

US 2021/0293498 A1 Sep. 23, 2021

Related U.S. Application Data

(60) Provisional application No. 62/992,691, filed on Mar. 20, 2020.

(51) Int. Cl.
*F41A 3/66* (2006.01)
*F41C 23/16* (2006.01)

(52) U.S. Cl.
CPC ..... *F41A 3/66* (2013.01); *F41C 23/16* (2013.01)

(58) Field of Classification Search
CPC ..... F41A 3/66; F41C 23/16
USPC ..... 42/75.02
See application file for complete search history.

(56) References Cited

U.S. PATENT DOCUMENTS 3,355,833 A 12/1967 Ruger et al.
4,312,146 A 1/1982 Koon, Jr.
4,539,889 A 9/1985 Glock
D285,236 S 8/1986 Brunton
4,879,827 A 11/1989 Gentry
4,941,394 A 7/1990 Zedrosser et al.
5,632,108 A 5/1997 Ruger et al.
5,913,261 A 6/1999 Guhring et al.
6,070,354 A 6/2000 Burigana et al.
6,298,594 B1 10/2001 Strayer
6,604,311 B1 8/2003 Laney et al.
6,640,479 B2 11/2003 Gühring et al.
7,213,359 B2 5/2007 Beretta
7,814,695 B1 10/2010 Keeney et al.
7,832,326 B1 11/2010 Barrett
8,141,287 B2 3/2012 Dubois
8,230,634 B1 7/2012 Davies et al.
8,316,756 B1 11/2012 Woodell et al.
8,387,296 B2 3/2013 Overstreet et al.
8,464,453 B1 6/2013 Ubl et al.
8,479,635 B2 7/2013 Overstreet et al.
8,789,305 B1 7/2014 DiChario
D713,483 S 9/2014 Firpo et al.
8,819,980 B2 9/2014 Geissele
D717,904 S 11/2014 Oglesby
D720,032 S 12/2014 Boutin
8,910,406 B1 12/2014 Huang et al.
9,032,860 B2 5/2015 Faxon
9,052,149 B2 6/2015 Bender
9,068,786 B2 6/2015 DiChario
9,297,599 B2 3/2016 Underwood et al.
(Continued)

*Primary Examiner* — Reginald S Tillman, Jr.

(57) ABSTRACT

An upper receiver assembly includes an outer member with an upper rail and an inner member with at least one of a pivot pin lug and a takedown pin lug. The inner member is disposed at least partially inside the outer member. The outer member includes an ejection port, and the inner member includes an ejection port. The ejection port of the inner member is at least partially aligned with the ejection port of the outer member.

26 Claims, 7 Drawing Sheets

(56) References Cited

U.S. PATENT DOCUMENTS

| | | | |
|---|---|---|---|
| D760,860 | S | 7/2016 | Vincent et al. |
| 9,389,033 | B1 | 7/2016 | Underwood et al. |
| 9,453,694 | B1 | 9/2016 | Storch |
| 9,494,382 | B2 | 11/2016 | Storch |
| 9,863,730 | B2 | 1/2018 | Elftmann |
| 9,952,011 | B2 | 4/2018 | Overstreet et al. |
| 10,018,437 | B2 | 7/2018 | Phipps et al. |
| 10,180,298 | B2 | 1/2019 | Noonan |
| 10,184,737 | B2 | 1/2019 | Roberts |
| 10,598,454 | B2 | 3/2020 | DiChario et al. |
| 10,641,563 | B2 | 5/2020 | Song et al. |
| 10,670,360 | B2 | 6/2020 | Underwood et al. |
| 2005/0011098 | A1 | 1/2005 | Fagundes de Campos |
| 2006/0207149 | A1 | 9/2006 | Lazor |
| 2006/0283067 | A1 | 12/2006 | Herring |
| 2011/0185614 | A1 | 8/2011 | Laney et al. |
| 2011/0214327 | A1 | 9/2011 | DeSomma |
| 2012/0023800 | A1 | 2/2012 | Laney |
| 2012/0111183 | A1 | 5/2012 | Hochstrate et al. |
| 2012/0137562 | A1 | 6/2012 | Langevin et al. |
| 2012/0167424 | A1 | 7/2012 | Gomez |
| 2013/0174457 | A1 | 7/2013 | Gangl et al. |
| 2013/0219763 | A1 | 8/2013 | Nunes |
| 2014/0000142 | A1 | 1/2014 | Patel |
| 2014/0224114 | A1 | 8/2014 | Faxon |
| 2014/0230297 | A1 | 8/2014 | Larson et al. |
| 2014/0331535 | A1 | 11/2014 | Robinson et al. |
| 2014/0352191 | A1 | 12/2014 | Fritz et al. |
| 2015/0000171 | A1 | 1/2015 | Roberts |
| 2015/0020426 | A1 | 1/2015 | Neergaard |
| 2015/0101230 | A1 | 4/2015 | Curtis |
| 2016/0054085 | A1 | 2/2016 | Miller, III |
| 2016/0327357 | A1 | 11/2016 | Wheatley |
| 2017/0299303 | A1 | 10/2017 | Phipps et al. |
| 2018/0023924 | A1 | 1/2018 | Storch |
| 2018/0087859 | A1 | 3/2018 | Underwood et al. |
| 2018/0347924 | A1 | 12/2018 | Satern |
| 2019/0086168 | A1 | 3/2019 | Song et al. |
| 2019/0226779 | A1 | 7/2019 | DiChario et al. |
| 2020/0256636 | A1 | 8/2020 | Martini |

MONOLITHIC UPPER RECEIVER ASSEMBLY

CROSS REFERENCE TO RELATED APPLICATION

This application is related to and claims priority benefit from U.S. Provisional Application No. 62/992,691 ("the '691 application"), filed on Mar. 20, 2020 and entitled "MONOLITHIC UPPER RECEIVER ASSEMBLY." The '691 application is hereby incorporated in its entirety by this reference.

FIELD OF THE INVENTION

The field of the invention relates to firearms, particularly monolithic upper receivers and related manufacturing methods in firearms.

BACKGROUND

Many modern firearms and firearm accessories (including handguns, rifles, carbines, shotguns, etc.) are designed based on existing modular firearm systems. For example, many firearms and related accessories are designed for compatibility with (i) the AR-15 variant (civilian) or M16/M4 (military) firearm platform and/or (ii) the AR-10 variant firearm platform. Many of these products follow traditional designs based on industry standards and/or military specification (milspec). To provide a handhold for the operator's forward (non-shooting) hand and to facilitate mounting accessories (including sights, optics, lights, and/or other objects), many firearms are designed with (or to be compatible with) a handguard that is attached as a separate component at the forward end of the upper receiver. However, in addition to being difficult to install and costly to manufacture, separate handguards that include attachment for optics or sights may limit accuracy of the firearm due to misalignment with the upper receiver.

To maximize manufacturing efficiency and simplify installation while increasing firearm accuracy, it may be desirable to design new monolithic upper receiver assemblies that combine features of an upper receiver and a handguard.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, an upper receiver assembly comprises: an outer member comprising an upper rail; and an inner member comprising at least one of a pivot pin lug and a takedown pin lug, wherein the inner member is disposed at least partially inside the outer member.

According to certain embodiments of the present invention, an upper receiver assembly comprises: an outer member comprising an upper rail, an aft portion, and a forward portion; an inner member comprising an ejection port; and at least one of a pivot pin lug and a takedown pin lug, wherein the inner member is disposed at least partially inside the outer member.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments shown in FIGS. 1-4C illustrate components of various semi-automatic or automatic firearms, the features, concepts, and functions described herein are also applicable (with potential necessary alterations for particular applications) to handguns, rifles, carbines, shotguns, bolt-action, lever-action, pump-action, or any other type of firearm. Furthermore, the embodiments may be compatible with various calibers including rifle calibers such as, for example, 5.56×45 mm NATO, .223 Remington, 7.62×51 mm NATO, .308 Winchester, 7.62×39 mm, 5.45×39 mm; pistol calibers such as, for example, 9×19 mm, .45 ACP, .40 S&W, .380 ACP, 10 mm Auto, 5.7×28 mm; and shotgun calibers such as, for example, 12 gauge, 20 gauge, 28 gauge, .410 gauge, 10 gauge, 16 gauge.

Figure 1:
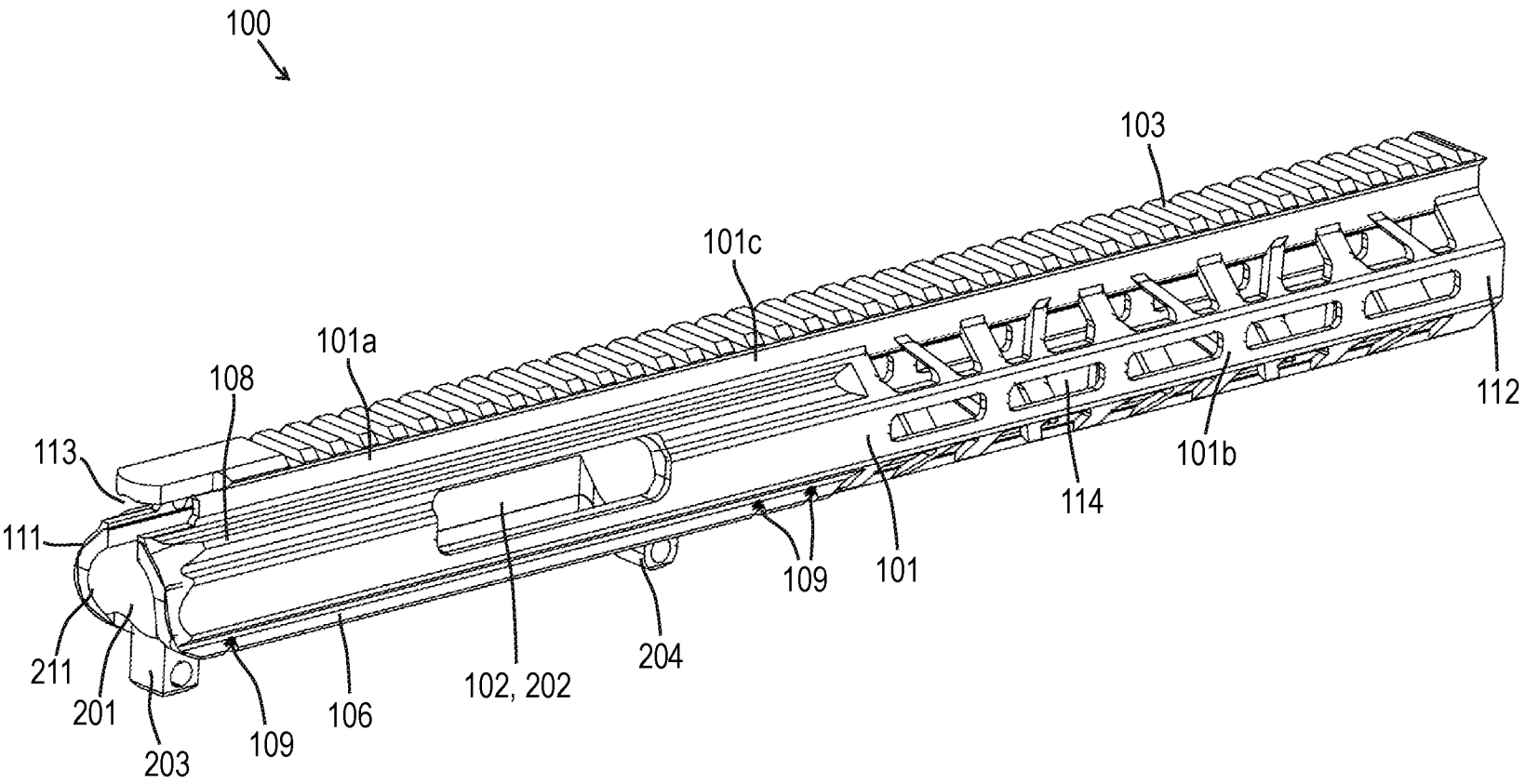
FIG. 1 is a right rear upper perspective view of a monolithic upper receiver assembly according to certain embodiments of the present invention.
Figure 2:
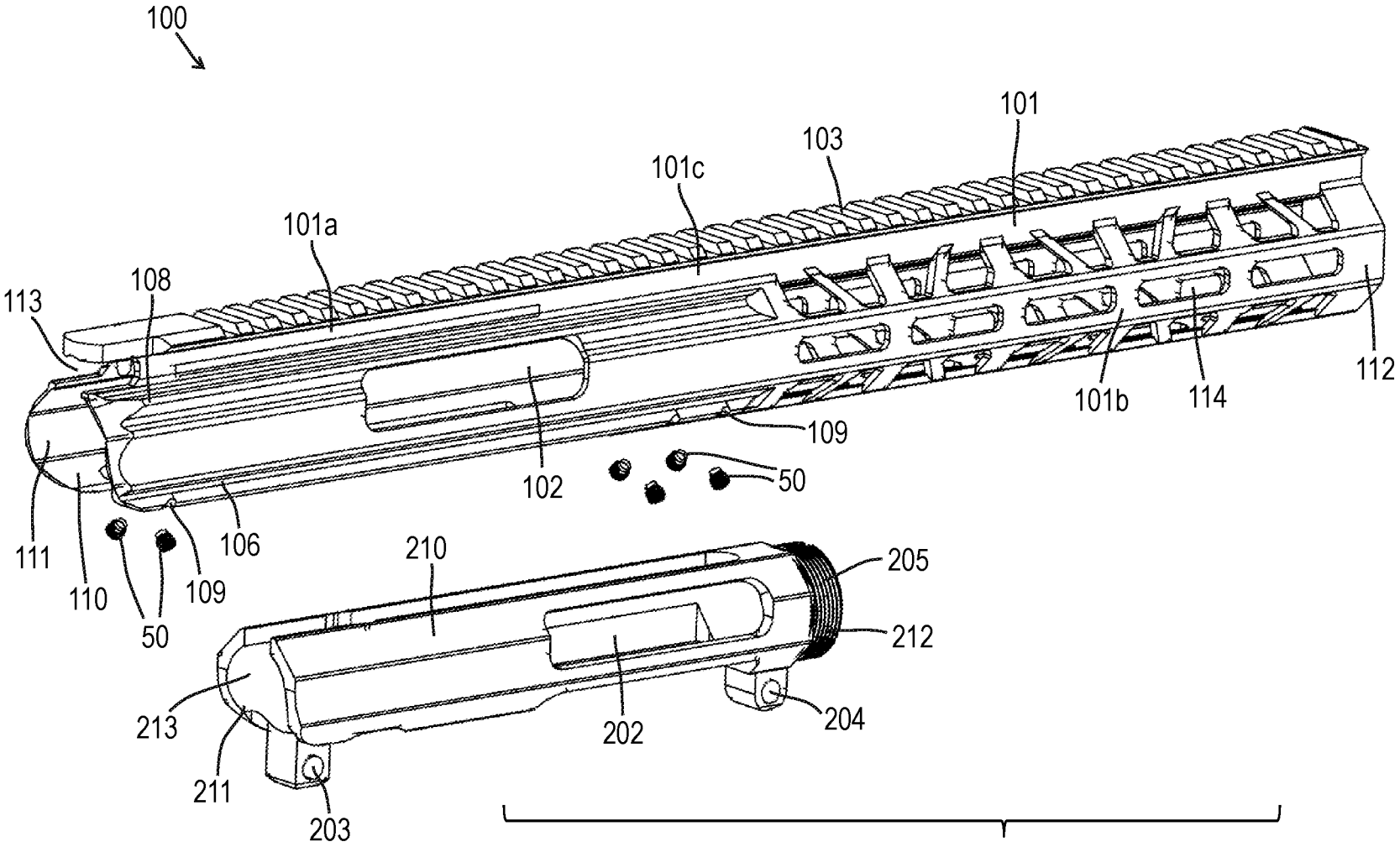
FIG. 2 is an exploded perspective view of the monolithic upper receiver assembly of FIG. 1.
Figure 3A:
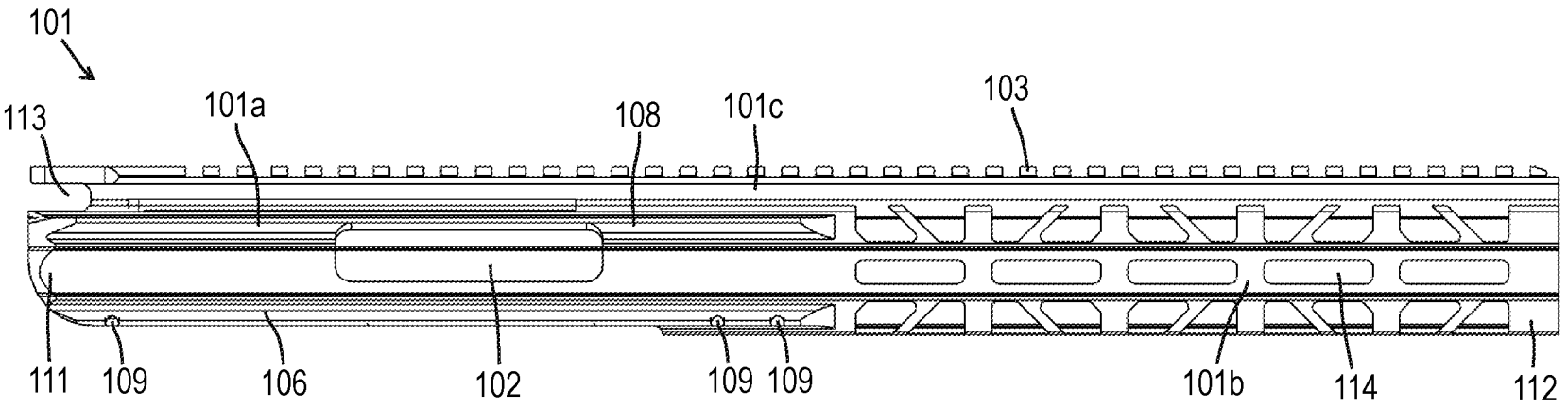
FIG. 3A is a right side view of an outer member of the monolithic upper receiver assembly of FIG. 1.
Figure 3B:
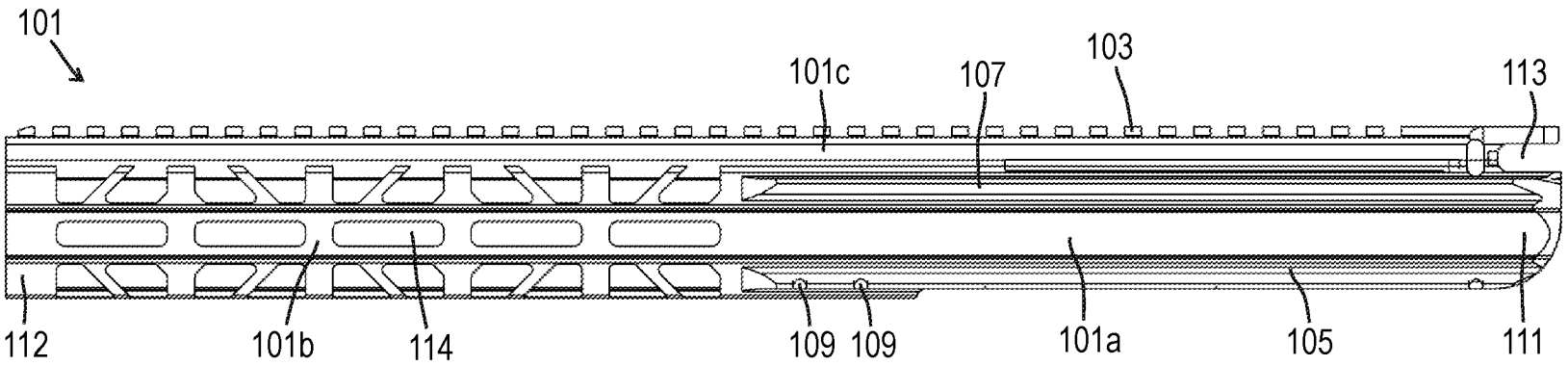
FIG. 3B is a left side view of the outer member of FIG. 3A.
Figure 3C:
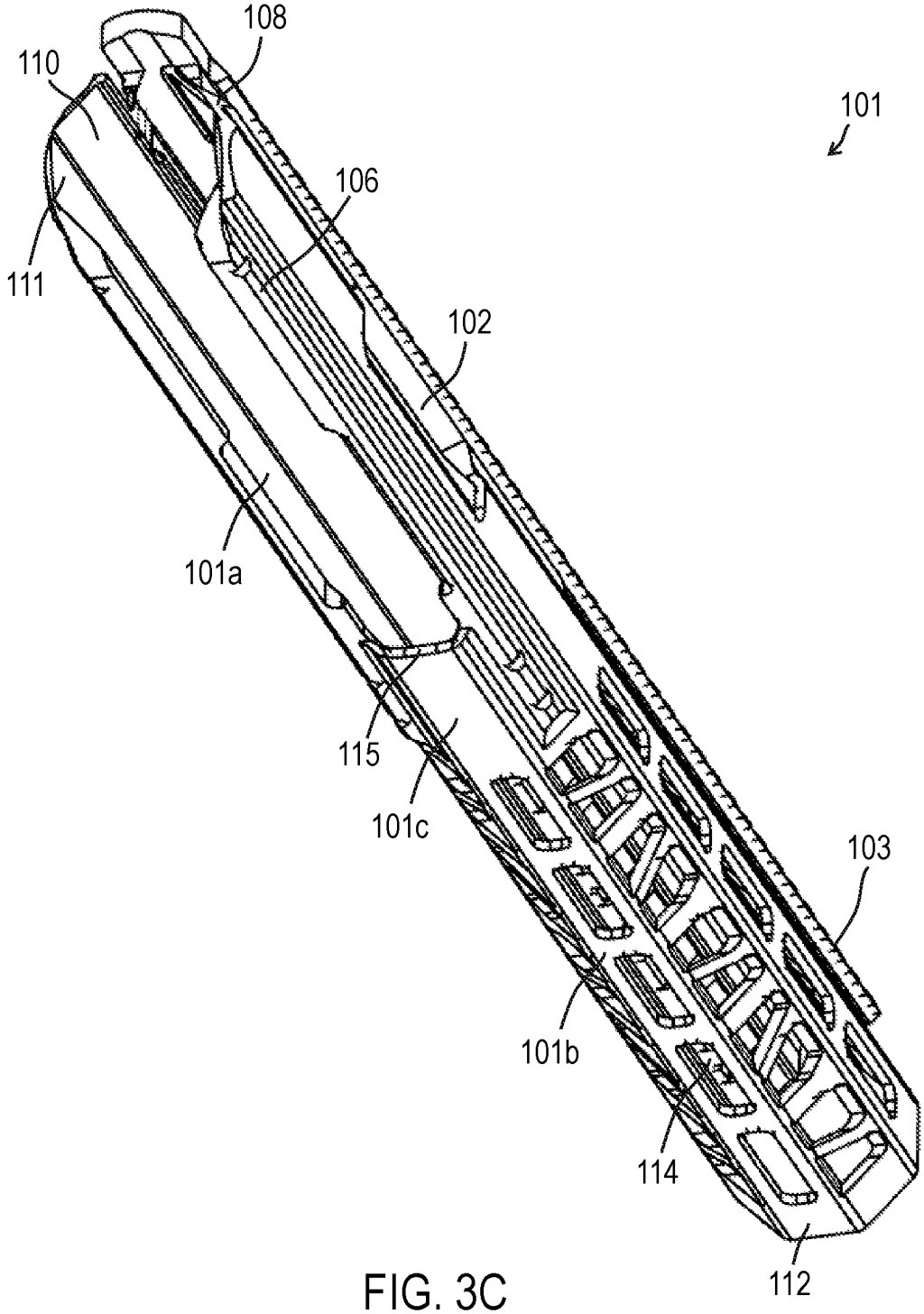
FIG. 3C is a right rear lower perspective view of the outer member of FIG. 3A.
Figure 3D:
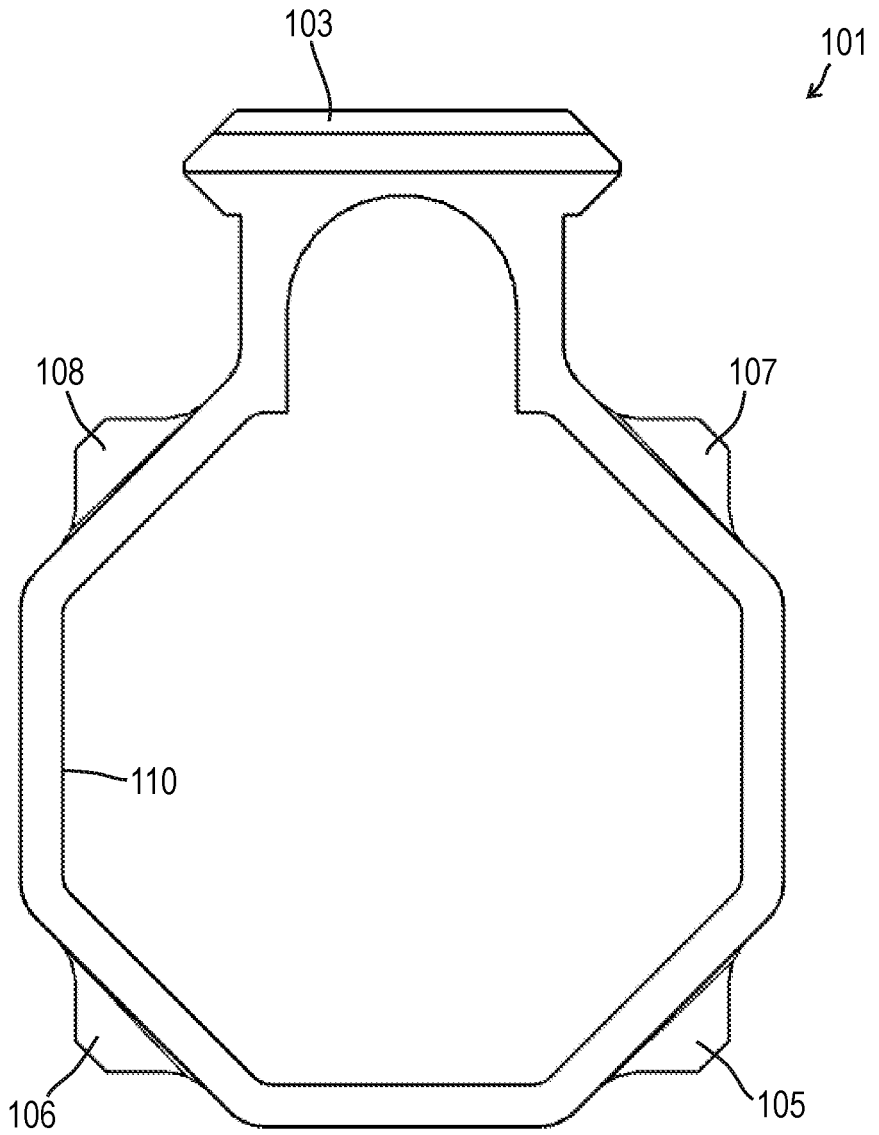
FIG. 3D is a front view of the outer member of FIG. 3A.
Figure 4A:
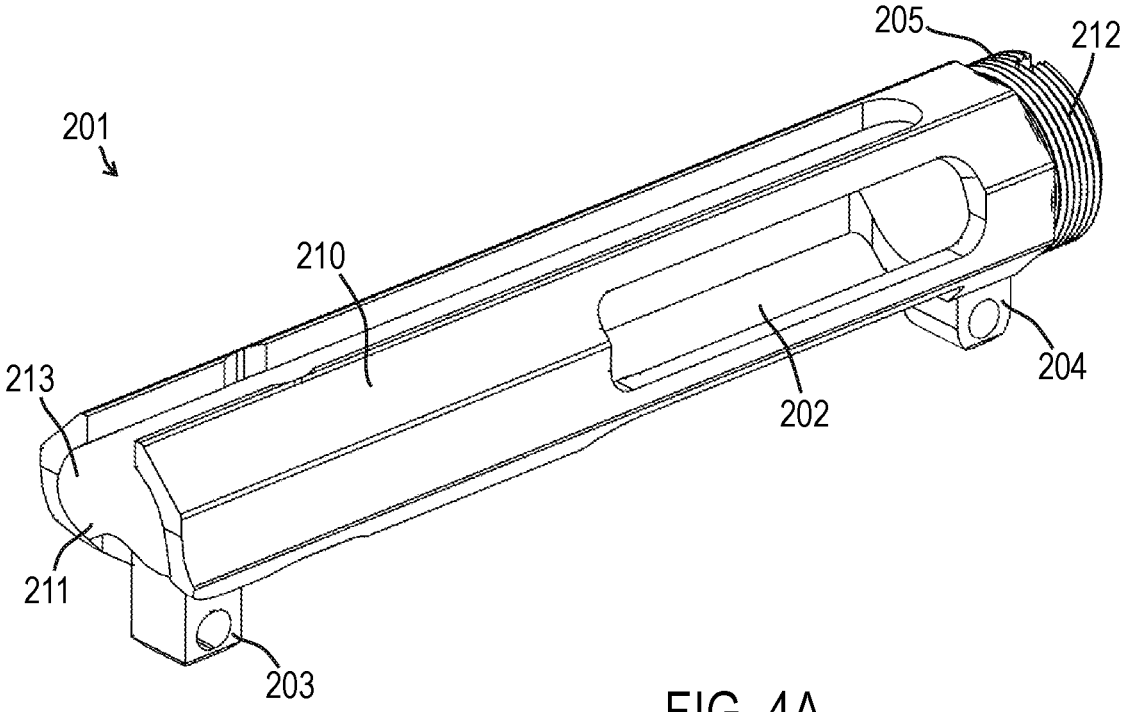
FIG. 4A is a right rear upper perspective view of an inner member of the monolithic upper receiver assembly of FIG. 1.
Figure 4B:
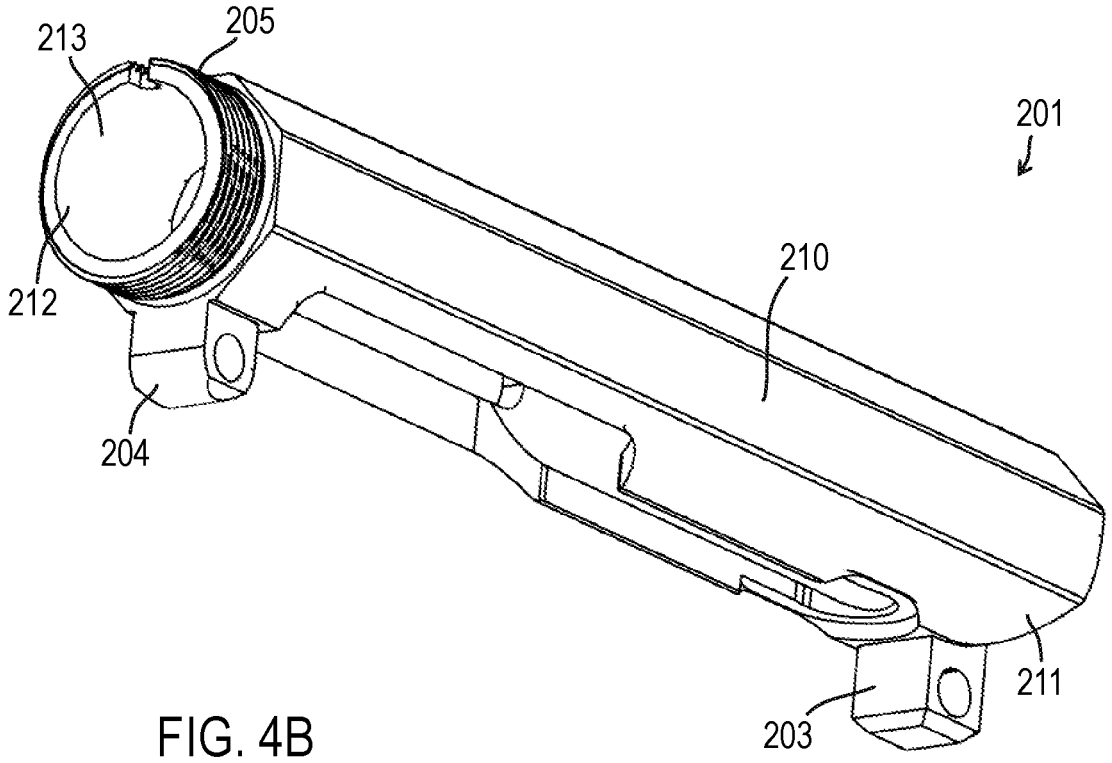
FIG. 4B is a left front lower perspective view of the inner member of FIG. 4A.
Figure 4C:
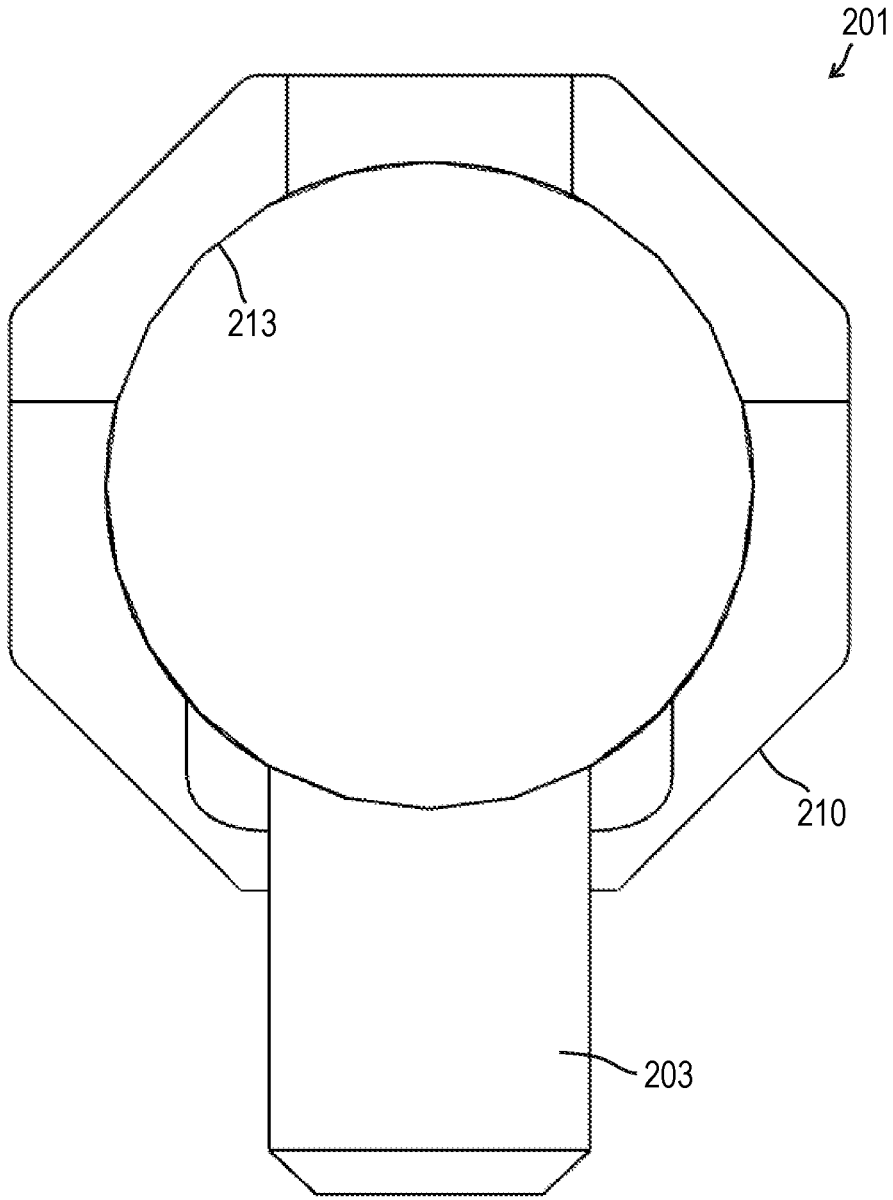
FIG. 4C is a rear view of the inner member of FIG. 4A.

In some cases, a monolithic upper receiver assembly 100 includes an outer member 101 and an inner member 201 (see FIGS. 1 and 2). As shown in FIG. 1, in some embodiments, the rear end 111 of the outer member 101 may be approximately aligned with the rear end 211 of the inner member 201. The front end 112 of the outer member 101 may be offset in the forward direction from the front end 212 of the inner member 201. In other embodiments, the front end 112 of the outer member 101 may be approximately aligned with the front end 212 of the inner member 201.

The outer member 101 may be designed as a single component to combine features that are typically part of the upper receiver and features that are typically part of the handguard in conventional firearms. As shown in FIGS. 1-3C, the outer member 101 may include an aft portion 101*a* and a forward portion 101*b*. The aft portion 101*a* may include features typically associated with the upper receiver of a conventional firearm including, for example, an ejection port 102, an upper rail 103, and an opening 113 for a charging handle. The forward portion 101*b* may include features typically associated with a handguard of a conventional firearm including, for example, an upper rail 103 and an array of openings 114. The array of openings 114 may be for aesthetic purposes, for facilitating cooling of the barrel and related components, and/or for other appropriate purposes. In some embodiments, an advantage of the outer member 101 is that upper rail 103 is a single constant feature along its full length, which is different from conventional firearms which include a portion of a rail on the upper receiver and a separate portion on the handguard. The upper rail 103 may be a Picatinny rail (MIL-STD-1913 rail or STANAG 2324 rail), a Weaver rail, or any other appropriate rail. Although the length of the forward portion 101*b* is shown as similar to the aft portion 101*a*, the forward portion 101*b* may be shorter or longer than the aft portion 101*a*. For example, in some cases, the forward portion 101*b* may be designed to extend approximately to the end of the barrel where the barrel can be any length from approximately 1" to 24" (2.54 cm to 60.96 cm) or any other appropriate length. In some cases, the outer member 101 is configured such that the front end 112 is located before an end of the barrel such that the barrel extends beyond the outer member 101 and a portion of the barrel is exposed. In other cases, the outer member 101 is configured such that the front end 112 is beyond an end of the barrel such that the barrel and at least a portion of a muzzle device (muzzle brake, compensator, flash hider, suppressor, etc.) is covered by the outer member 101.

As shown in FIGS. 1-3D, the outer member 101 may include a plurality of ribs 105-108 that extend along at least a part of the length of the outer member 101. The illustrated embodiments show four ribs, including a lower left rib 105, a lower right rib 106, an upper left rib 107, and an upper right rib 108. However, the outer member 101 may be designed with any number of ribs, including fewer (as many as zero) or more ribs than the illustrated embodiments. The ribs 105-108 may be included for aesthetic purposes, may provide structural benefit (increasing bending stiffness), and/or may have other advantages. In some cases, the ribs 105-108 include holes 109 for fasteners 50 for securing the outer member 101 relative to the inner member 201, a barrel nut (not shown), and/or other components of the firearm. The illustrated embodiments show the ribs 105-108 that taper to an approximately rectangular cross-section, but the ribs 105-108 may have a cross-section with any other appropriate shape. Alternative appropriate shapes may be optimized for structural purposes and/or for using the rail as an attachment for accessories. For example, in some embodiments, the ribs 105-108 have a dovetail shaped cross-section to allow attachments to be secured to the ribs 105-108. As one example, the upper right rib 108 and/or the lower right rib 106 may be configured to allow a shell deflector and/or an ejection port door to be attached adjacent to the ejection port 102. In addition, one of more of the ribs 105-108 may be configured to allow for accessories to be mounted to the outer member 101 including, for example, sights, optics, lights, and any other appropriate accessory.

In some embodiments, the outer member 101 includes a transition portion 101*c* located between the aft portion 101*a* and the forward portion 101*b*. As shown in FIG. 1, the transition portion 101*c* is located forward of the pivot pin lug 204 of the inner member 201 such that the transition portion 101*c* is forward of a traditional upper receiver. In some cases, the location of the transition portion 101*c* corresponds to the location of a barrel nut, which attaches the barrel to the inner member 201. In some embodiments, the transition portion 101*c* of the outer member 101 includes a plurality of holes 109 such that fasteners 50 can fasten the outer member 101 directly to the barrel nut. Although the illustrated embodiments show holes 109 through the lower left rib 105 and the lower right rib 106, the outer member 101 may include includes holes through any or all of the ribs 105-108 for securing the outer member 101 to the barrel nut. In some embodiments, the outer member 101 includes an interface surface 115 that engages the pivot pin lug 204 of the inner member 201 to define a forward/aft location between the outer member 101 and the inner member 201 (and/or to align the hole(s) 109 with the barrel nut).

The inner member 201 may be designed to include some of the features that are typically part of the upper receiver in conventional firearms. As shown in FIGS. 2 and 4A-4C, the inner member 201 may include an ejection port 202, a takedown pivot lug 203, a pivot pin lug 204, and a threaded portion 205 for attaching barrel using a barrel nut. In some embodiments, the ejection port 202 of the inner member 201 is at least partially aligned with the ejection port 102 of the outer member 101. The inner member 201 may also include an interior cavity 213 designed to interface with a bolt carrier group (not shown). For some embodiments, an advantage of the inner member 201 is that some of the most critical features associated with conventional upper receivers including the takedown pivot lug 203, the pivot pin lug 204, the threaded portion 205, and the interior cavity 213 are incorporated into a component that is simpler to make than conventional upper receivers. For example, the faceted outer surface 210 of the inner member 201 would require significantly less machining (and less material) compared to a conventional upper receiver (assuming both components are metallic). Moreover, upper receiver assembly 100 can be designed to reduce the amount of high strength materials necessary. For example, the inner member 201 may be made from a more expensive high strength material while the outer member 101 can be made from a less expensive lower strength material (or from a composite material, a carbon fiber material, or a polymer material, as described below). In some embodiments, the inner member 201 is made from steel, titanium, aluminum, and/or any other appropriate material. In other embodiments, the inner member 201 is made from a 7000 series aluminum alloy (most upper receivers are made from 7000 series aluminum alloy) and the outer member 101 is made from a 6000 series aluminum alloy (most handguards are made from 6000 series aluminum alloy). In some embodiments, the inner member 201 is made from 7075 aluminum alloy and the outer member 101 is made from 6061 aluminum alloy. In other embodiments, the outer member 101 is made from a polymer material. In some embodiments, the outer member 101 is a polymer material including, for example, plastic, thermoplastic, nylon, polyetherimide, polyoxymethylene (acetal), polytetrafluoroethylene, polyethylene, polypropylene, polyvinyl chloride, polystyrene, carbon composite, and/or other plastic or polymer materials.

The configuration of upper receiver assembly 100 may also lead to more streamlined manufacturing processes. In some embodiments, the outer member 101 is based on extrusions of the shape shown in FIG. 3D. After extruding the shape shown in FIG. 3D and cutting to an appropriate length, the component can be machined to create the ejection port 102, the array of openings 114, the opening at the underside of the aft portion 101*a*, and other relevant features.

Fitment between the outer member 101 and the inner member 201 may be based on an approximate line-to-line fit between the inner surface 110 of the outer member 101 and outer surface 210 of the inner member 201. Although the illustrated embodiments show a faceted octagonal arrangement for the inner surface 110 of the outer member 101 and the outer surface 210 of the inner member 201 (see FIGS. 3D and 4C), these components can be designed with any relevant shape including, for example, square, rectangular, pentagonal, hexagonal, any regular or irregular polygonal shape, a circular shape, an oval shape, etc.

For assembling and installing the upper receiver assembly 100, in some embodiments, a barrel and barrel nut would be installed at the threaded portion 205 of the inner member 201. The inner member 201 would then be inserted into the outer member 101 until the rear end 211 of the inner member 201 is approximately aligned with the rear end 111 of the outer member 101. After inserting the inner member 201 into the outer member 101, fasteners 50 can be inserted into holes 109 of the outer member 101. Some of the fasteners 50 may be set screws designed to thread into holes 109 of the outer member 101 and to press against outer surface 210 of the inner member 201 (e.g., against a flat facet). In some embodiments, the outer surface 210 of the inner member 201 includes threaded blind holes such that fasteners 50 thread into one or both of the outer member 101 and the inner member 201. In addition, as described above, some of the holes 109 may be located in the transition portion 101*c* of the outer member 101 such that the fasteners 50 pass through the outer member 101 and thread into holes in a barrel nut.

In other embodiments, the outer member 101 may be over molded in an appropriate position relative to the inner member 201. For example, in some embodiments, at least a portion of the inner member 201 is inserted into a molding machine and held in position adjacent to a cavity. Material (such as polymer in a liquid form) is then injected into the cavity and cured to form the final shape of the outer member 101. Such a process simplifies and reduces labor associated with making and installing the outer member 101. In addition, over molding the outer member 101 allows for a more robust mechanical attachment between the outer member 101 and the inner member 201. In some embodiments, an over molded outer member 101 may include a secure mechanical connection that cannot be disengaged without destroying the upper receiver assembly 100. For embodiments where the outer member 101 is over molded relative to the inner member 201, the barrel and barrel nut would be installed at the threaded portion 205 after the outer member 101 and the inner member 201 are secured to one another.

The components of any of the upper receiver assembly 100 described herein may be formed of materials including, but not limited to, thermoplastic, carbon composite, plastic, nylon, polyetherimide, steel, aluminum, stainless steel, high strength aluminum alloy, other plastic or polymer materials, other metallic materials, other composite materials, or other similar materials. Moreover, the components may be attached to one another via suitable fasteners, which include, but are not limited to, screws, bolts, rivets, welds, over molding, injection molding, epoxy, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. An upper receiver assembly comprising:
an outer member comprising an upper rail; and
an inner member comprising at least one selected from the group of a pivot pin lug and a takedown pin lug, wherein:
the inner member is disposed at least partially inside the outer member;
the upper rail extends as a single continuous member from an opening for a charging handle to a forward end of a handguard portion of the outer member; and
the outer member is over molded relative to the inner member to permanently attach the outer member and the inner member.

2. The upper receiver assembly of claim 1, wherein:
the outer member comprises an ejection port;
the inner member comprises an ejection port; and
the ejection port of the inner member is at least partially aligned with the ejection port of the outer member.

3. The upper receiver assembly of claim 1, wherein the handguard portion is disposed forward of the pivot pin lug.

4. The upper receiver assembly of claim 1, wherein the inner member comprises a metallic material.

5. The upper receiver assembly of claim 1, wherein the outer member comprises a polymer material.

6. The upper receiver assembly of claim 1, wherein the outer member comprises an aft portion and a forward portion.

7. The upper receiver assembly of claim 6, wherein:
the aft portion comprises an ejection port and the opening for the charging handle;
the forward portion comprises an array of openings; and
the upper rail is a single continuous member extending along both the aft portion and the forward portion.

8. The upper receiver assembly of claim 6, wherein the outer member further comprises a transition portion located between the aft portion and the forward portion.

9. The upper receiver assembly of claim 8, wherein the transition portion corresponds to the location of a barrel nut, which attaches a barrel to the inner member.

10. The upper receiver assembly of claim 1, wherein the opening for the charging handle is disposed at a rear end of the outer member.

11. An upper receiver assembly comprising:
an outer member comprising an upper rail, an aft portion, and a forward portion;
an inner member comprising an ejection port;
at least one of a pivot pin lug and a takedown pin lug; and a plurality of fasteners for securing the outer member and the inner member relative to one another, wherein:

the inner member is disposed at least partially inside the outer member;

the outer member comprises an opening for a charging handle; and at least one of the fasteners is disposed forward of the ejection port.

12. The upper receiver assembly of claim 11, wherein the forward portion comprises a handguard portion.

13. The upper receiver assembly of claim 11, wherein:

the outer member comprises an ejection port; and the ejection port of the inner member is at least partially aligned with the ejection port of the outer member.

14. The upper receiver assembly of claim 11, wherein the opening for the charging handle is disposed at a rear end of the outer member.

15. The upper receiver assembly of claim 11, wherein the outer member is an extrusion.

16. The upper receiver assembly of claim 11, wherein the outer member comprises a polymer material.

17. The upper receiver assembly of claim 11, wherein:

the aft portion comprises an ejection port and the opening for the charging handle;

the forward portion comprises an array of openings; and the upper rail is a single continuous member extending along both the aft portion and the forward portion.

18. The upper receiver assembly of claim 11, wherein the outer member further comprises a transition portion located between the aft portion and the forward portion.

19. The upper receiver assembly of claim 18, wherein the transition portion corresponds to the location of a barrel nut, which attaches a barrel to the inner member.

20. The upper receiver assembly of claim 19, wherein at least one of the fasteners attaches the outer member to the barrel nut.

21. An upper receiver assembly comprising:

an outer member comprising an upper rail, an aft portion, a forward portion, and a transition portion located between the aft portion and the forward portion;

an inner member comprising at least one selected from the group of a pivot pin lug and a takedown pin lug; and at least one fastener for securing the outer member and the inner member relative to one another, wherein:

the inner member is disposed at least partially inside the outer member;

the transition portion corresponds to the location of a barrel nut, which attaches a barrel to the inner member; and the at least one fastener attaches the outer member directly to the barrel nut.

22. The upper receiver assembly of claim 21, wherein the outer member comprises a polymer material.

23. An upper receiver assembly comprising:

an outer member comprising an upper rail, an aft portion, a forward portion, and an ejection port;

an inner member comprising an ejection port; and at least one of a pivot pin lug and a takedown pin lug, wherein:

the inner member is disposed at least partially inside the outer member; and the ejection port of the inner member is at least partially aligned with the ejection port of the outer member; and the outer member is over molded relative to the inner member to permanently attach the outer member and the inner member.

24. The upper receiver assembly of claim 23, wherein the outer member comprises a polymer material.

25. The upper receiver assembly of claim 1, wherein the over molding process comprises first manufacturing the inner member and locating the inner member within a cavity of a molding machine and subsequently injecting polymer in liquid form into the cavity to form the outer member.

26. The upper receiver assembly of claim 11, wherein the outer member is over molded relative to the inner member to permanently attach the outer member and the inner member.

* * * * *